US005200269A

United States Patent [19]

Lukhard et al.

[11] Patent Number: 5,200,269

[45] Date of Patent: Apr. 6, 1993

[54] APPARATUS AND METHOD FOR BALING CUT FIBERS AND PRODUCT

[75] Inventors: Craig R. Lukhard, Newark; Elwood A. Roth, Seaford, both of Del.; Maurice C. Todd, Chadds Ford, Pa.

[73] Assignee: E. I. Du Pont de Nemours and Company, Wilmington, Del.

[21] Appl. No.: 531,661

[22] Filed: Jun. 1, 1990

[51] Int. Cl.[5] ..... D02G 3/00; B65D 91/00

[52] U.S. Cl. ..... 428/362; 206/83.5; 100/3

[58] Field of Search ..... 428/219, 362, 298; 206/83.5; 19/66.1

[56] References Cited

U.S. PATENT DOCUMENTS

| | | | |
|---|---|---|---|
| 132,566 | 10/1872 | Dederick | 206/83.5 |
| 3,188,790 | 6/1965 | Hebeler | 428/362 |
| 3,479,747 | 11/1969 | McGill | 34/22 |
| 3,549,741 | 12/1970 | Caison et al. | 264/103 |
| 3,962,846 | 6/1976 | Neitzel et al. | 53/528 |
| 4,006,679 | 2/1977 | Egosi | 100/138 |
| 4,041,855 | 8/1977 | Egosi | 100/138 |
| 4,127,062 | 11/1978 | Egosi | 100/215 |
| 4,268,940 | 5/1981 | Kuroda et al. | 28/255 |
| 4,343,069 | 8/1982 | McLuskie et al. | 19/0.6 |
| 4,882,222 | 11/1989 | Talley, Jr. et al. | 428/362 |

FOREIGN PATENT DOCUMENTS 1553208 9/1979 United Kingdom .

*Primary Examiner*—George F. Lesmes
*Assistant Examiner*—Chris Raimund

[57] ABSTRACT

A process for producing a bale of crimped staple fibers includes the repeated steps of cutting continuous filament crimped nylon tow into segments, maintaining the integrity of the segments while tramping charges of the segments under pressure to form a compacted layer, holding the layer to retain layer compaction and then pressing the layers and strapping the pressed layers.

2 Claims, 8 Drawing Sheets

APPARATUS AND METHOD FOR BALING CUT FIBERS AND PRODUCT

BACKGROUND OF THE INVENTION

This invention relates to an apparatus and method for baling crimped nylon staple fibers.

The known practice of air doffing or air conveying cut 4 to 8 inch length tufts of crimped staple carpet fibers from a rotary cutter causes entangling of the fibers to a degree that the cut tufts combine into large clumps of randomly oriented fibers which greatly increases the force required to compress a bale of such fibers to its desired final size and also increases the amount of rebound or bloom experienced on opening the bale. This problem is also experienced in gravity doffing systems from rotary cutters where the fibers are allowed to condense by twisting during removal from the cutter. In addition, the conventional practice of pushing large volumes of such cut entangled fibers into a baling chamber or allowing them to free fall a long distance into a tramping chamber promotes further mixing and entangling of the fibers. When bales of these cut staple fibers are then processed in a mill using opening, blending and carding systems, the staple fibers, because of the entanglement, are difficult to process. For example, when such fibers are carded to comb them to parallelism, they may, because of entanglement, be snarled into neps, stretched until crimp is permanently removed or the filaments break.

SUMMARY OF THE INVENTION

The present invention is particularly advantageous when compared to prior art products in that the bale of crimped nylon staple is formed of easily separable layers which in turn have low entanglement, i.e. are easily separated into layers or clumps. The bale is further characterized in that the baled product has the following characteristics:

- a strapped bale density of between 18–26 lb/ft$^3$ and a 7-day, unstrapped bale density of between 9–12 lb/ft$^3$ throughout the bale;
- a filament crimp level of the fiber within the bale of at least about 6–20 crimps per inch, a filament denier of at least about 6 denier per filament and a crimped cut length of about 4"–8"and a moisture content of from about 4 to about 8 percent;
- a 7-day bale bloom when the bale is unstrapped which is between 50–100% of the strapped bale height;
- a bale structure which, when the bale is unstrapped, can be seen as distinct layer structures, wherein each layer:
  - has bulged edges that meet the adjacent layer's bulged edges to form a defined peripheral interface between layers;
  - has low fiber entanglement with the adjacent layer so that the layers can be separated at an interface plane;
  - has substantially the same unstrapped density as the overall bale;

Such a baled product compared to conventional bales has the following advantages:

- it requires lower residual strap tension and has low bloom so when unstrapped, it provides a safer, more stable bale;
- it can be debaled very quickly with less effort;

- it can be separated (opened) very quickly into loose open clumps;
- it can be further separated, aligned, and parallelized by the mill opening and carding operation with less power consumption per pound for a given crimp level;
- can be processed at higher rates during opening and blending for a given crimp level;
- results in less filament breakage and equipment jamming and clogging during opening and carding;
- results in better carding performance and uniform sliver production during processing.

The process for producing the bale also involves a new combination of steps that minimize entanglement of cut fiber segments, uniformly tramp each charge of segments to a preselected pressure, and overpress the bale before strapping. The process consists of the following steps:

- continuously cutting the fiber tow into segments and doffing the cut tow segments by directing the segments radially outward and downward utilizing centrifugal and gravitational forces for extending and separating the segments perpendicular to the filaments;
- continuously transporting the separated segments along angled slides by gravity to a charge chamber;
- depositing the charge onto a support platen at a tramping position;
- accumulating the continuously transported segments to form the next charge;
- tramping the charge in the tramping position to a preselected pressure to form a compacted layer and pressing the support platen down one layer thickness;
- holding the last compacted layer in place to retain the layer compaction;
- depositing the next charge onto the last compacted layer at the tramping position;
- repeating the tramping, depositing and accumulating steps until there are a plurality of compacted layers to form a bale;
- pressing the bale to a first pressure higher than the preselected tramping pressure;
- partially reducing the pressing to a pressure intermediate the first and preselected pressures;
- strapping the bale to hold the compacted layers against expansion.

In a preferred process, the preselected pressure compacts the layers to a density between 10 to 15 lbs/ft$^3$, the first pressure compacts the entire layered bale to a density between 36–38 lb/ft$^3$ and intermediate pressure compacts the bale to a density between 26–28 lbs/ft$^3$.

In another preferred process, the overpressure step compacting the bale with a first pressure may be omitted.

DETAILED DESCRIPTION OF THE PREFERRED EMBODIMENT

Figure 1:
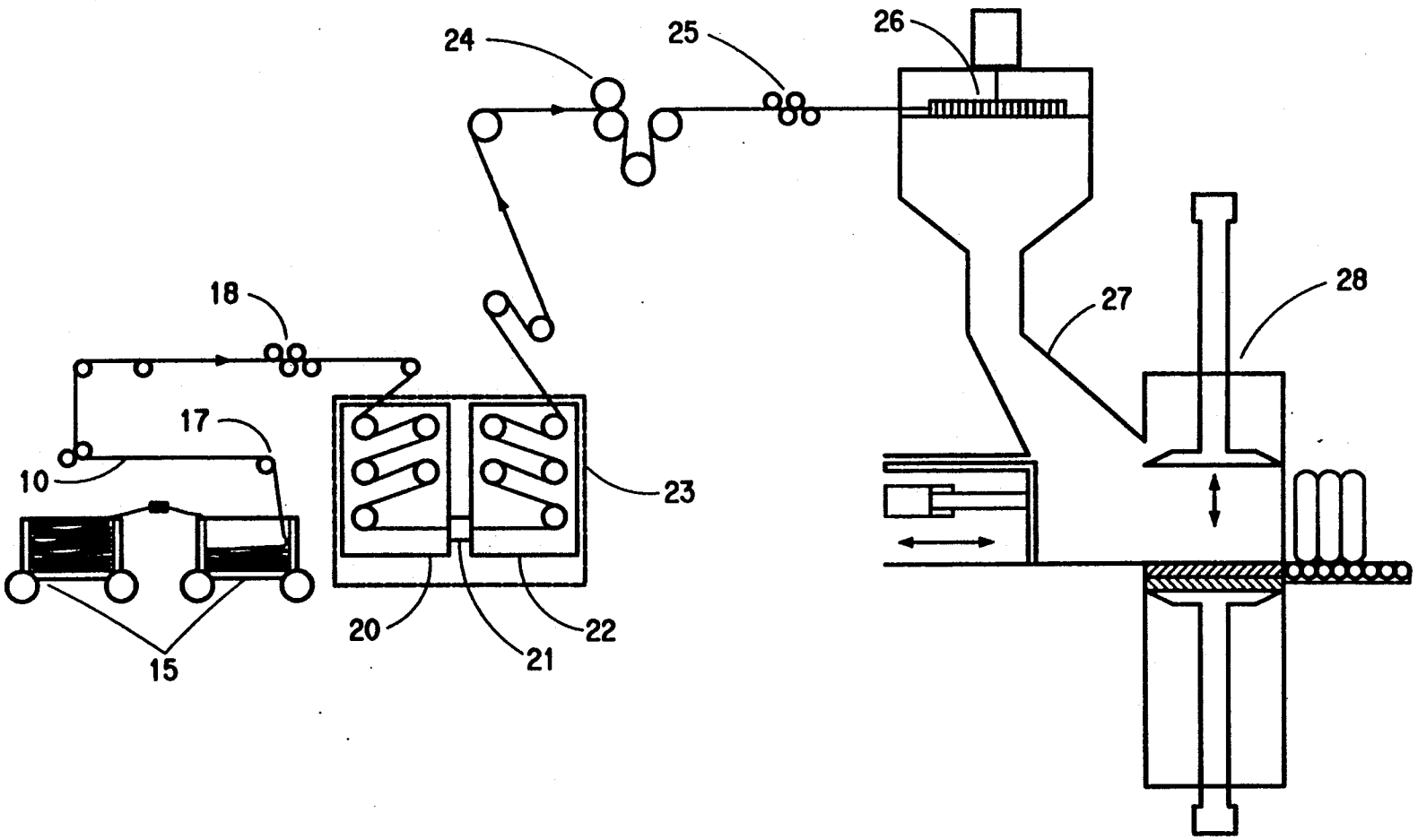
FIG. 1 is a schematic diagram of the process of this invention.

Referring to FIG. 1, crimped tow 10 is taken from storage device 15, inspected for broken or stretched filaments by detectors 17 and 18, and passes onto feed rolls 20 of stretching device 23 for deregistering the tow. The device 23 includes driven and draw rolls 22. Tension detector 21 is located between the two sets of rolls. The output of tension detector 21 is linked to a speed control circuit for feed rolls 20 to maintain substantially constant tension between rolls 20 and 22. The degree of crimp in the crimped tow approaching stretching device 23 can vary and the speed control circuit for feed rolls 20 corrects for regions of such fluctuations in tension caused by such crimp variations.

Following the stretching device for deregistering the crimped tow, the tow passes through tow ribbon tensioning and aligment device 24 and defect detectors 25. The tow is then fed to cutter 26. It is very important that the cutter produces unentangled segments of tow. A cutter that has been found to work well is a circular cutter with radial blade portions such as described in U.S. Pat. No. 4,343,069, which is incorporated herein by reference. This cutter is modified from that shown in the patent by placing the cutter exit downward for gravity ejection without air assist and adding an elastomeric deflection ring and expanded containment chamber at the exit of the cutter.

After cutting, the cut segments of tow, or staple, fall by gravity onto inclined surfaces in chute 27 which convey the staple to baler 28. Baler 28 laterally loads relatively sma'l charge of staple onto the top of a raised support platen so no significant free fall and entanglement of staple segments occurs. The charge is tramped to a preselected pressure and each layer is retained by dogs. The baler support platen is lowered by the downward force of the tramper platen as each subsequent charge is loaded and tramped. The bale is then indexed to a compression and strapping station where the bale is overpressured, relaxed, wrapped and strapped.

Tow Cutter

Figure 2:
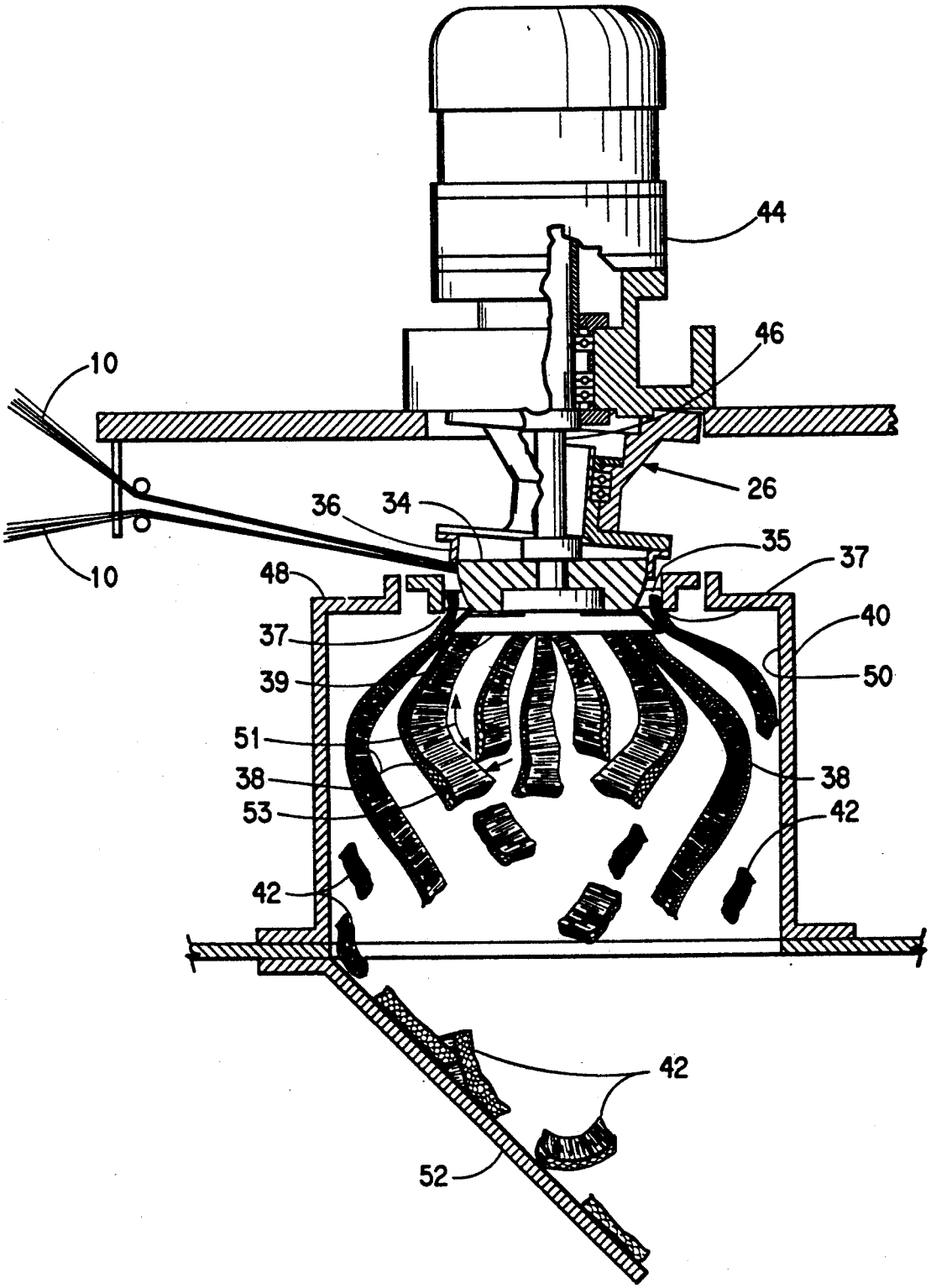
FIG. 2 is a side elevation view partially in section of a cutter useful in practicing the invention.

FIG. 2 shows the modified cutter 26. To achieve the denier capacity of the cutter, two tow bands 10 are combined one above the other and fed to the cutter. The combined tow ropes are wrapped circumferentially around the cutter disc assembly 34 with the topes stacked one above the other. About 1 ½ to 2 wraps of combined tow are stacked, slid axially downward along the disc, and pushed against the blades 35 by a tilted tow pressing ring 36. At the annular exit of the cutter at 37 there is an annular elastomeric deflection ring 39 attached to the cutter disc assembly 34. This forces the cut tow segments outward slightly even when the cutter is stationary to minimize entanglement when the cutter is stopped and started. The cut segments entangle slightly with the adjacent stacked tow rope to produce columns of cut segments, such as 38, depending from the cutter blades under gravity. The ends of these depending columns break off randomly as they rotate within housing 40 to form individual cut fiber or staple segments, such as 42. These may be individual segments from a single tow rope, from a partial tow rope, or from several tow ropes. The cutter disc assembly with blades are rotationally driven by motor 44 via shaft 46. The pressing ring 36 is frictionally driven at the same speed by tis pressing engagement with the tow. The cutter and ring rotate together then so the columns of cut segments also rotate. Placing the wall 50 of the stationary containment chamber 40 radially outward form the cutter exit at 37 is important. Centrifugal force on the columns 38 causes them to move radially outward so the cut segment columns are spaced away from each other. As the columns move to a larger radius, the centrifugal force also increases which beneficially separates the end off the column.

The outward step 48 from the cutter exit to the chamber wall surface 50 causes the columns to bend outward significantly. This extends and opens the segments in a direction 51 perpendicular to the cut filament length 53 and enhances the breakup of the columns into discrete segments 42 of varying column length. Since the columns are moved outward they separate from one another and very little entanglement between columns and/or segments occurs. This is an important condition that must be maintained. It is significant that air separation techniques are not used to break up the columns or carry the segments away from the cutter since these have been found to increase entanglement between the cut columns and segments. In known cutters using air doffing, the column of fibers is pulled into a stationary duct while the column may still be rotating at eh cutter ring so column twisting occurs that inhibits column breakup and creates highly entangled segments.

Figure 3:
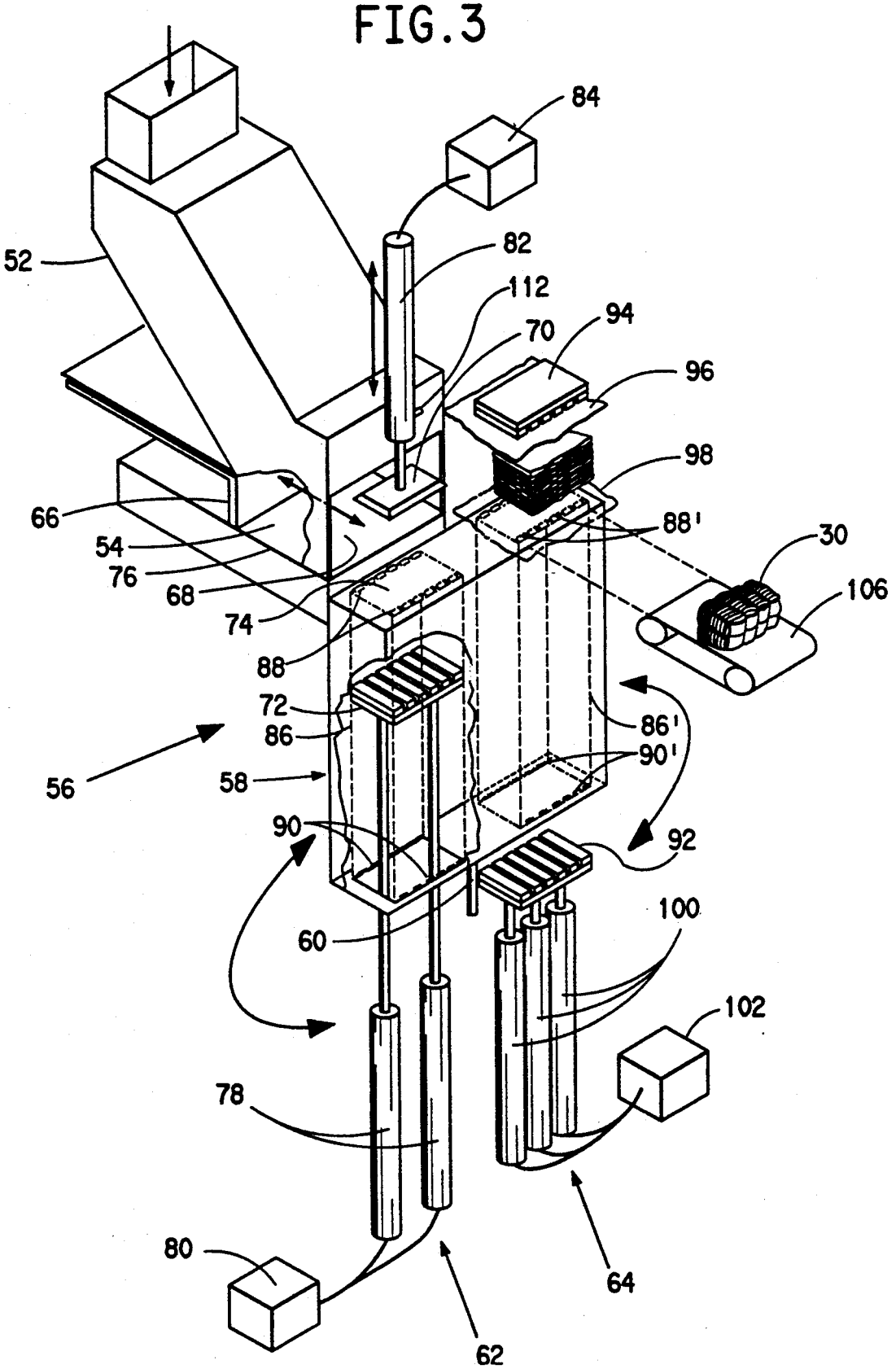
FIG. 3 is a schematic of a baler useful in the process of this invention.

After cutting and segmenting of the cut columns of fibers, it is important that the segments are not dropped onto surfaces from a great height that may cause twisting and entanglement. To transport the segments and change elevation, it is preferred that angled surfaces, such as 52, be provided upon which the segments can slide freely so their unentangled orientation can be retained and the fiber segments remain as discrete lengths without rolling or twisting around themselves or other segments. This type of entanglement if allowed to occur results in high separating forces required to pull segments apart which is undesired. If instead, the segments were allowed to free fall, it is believed the changes for entanglement are increased. Referring to FIG. 3, these unentangled segments are then dropped a short distance into a change chamber at 54 ready for baling.

Baler

As shown in FIG. 3, baler 56 has dual box assembly 58 that rotates about axis 60 to move the staple fiber from a tramping station 62 to a pressing and strapping station 64. A similar baler is described in U.S. Pat. No. 3,962,846 which is incorporated herein by reference. This referenced baler has been modified with the addition of a moveable support platen with associated hydraulics and controls at the tramping station, and different controls for the process. At the tramping station there is a pusher 66 that empties the charge chamber 54 through opening 68 to place the fiber charge under tramping platen 70. The support platen 72 at the tramping station is in a raised position during loading of the charge so that the top of the last tramped layer at 74 is just below the bottom of the charge chamber at 76. This eliminates any significant fall of the segments entering chamber 86 so entanglement of the segments is minimized. The support platen is positioned by hydraulic cylinders 78 which are controlled by valve assembly 80. Tramping platen 70 is positioned by hydraulic cylinder 82 controlled by valve assembly 84. Each charge is tramped to a preselected pressure and the support platen is progressively pushed down until chamber 86 is full. The preselected pressure may be constant or may be varied for each layer. A plurality of retaining dogs 88 engage the long sides of the top layer to prevent re-expansion of the layer after tramping. It is important that all layers but the last few layers are held at the tramping pressure for more than about 20 seconds. This increases uniformity of compaction and reduces bloom of each layer. When full, the lower support platen 72 is lowered thereby expanding the bale uniformly until the platen passes through the lower fiber retaining fingers (dogs) 90 which retain the tramped, layered fiber in chamber 86. The support platen 72 is slotted to mate closely with the lower retaining fingers 90. The dual box assembly is then rotated to place the tramped fiber at the pressing and strapping station 64.

At the pressing and strapping station, the retaining fingers 90 are opened to admit pressing platen 92 into chamber 86. The platen 92 and chamber 86 move up together against fixed platen 94. The platen 92 then continues up which pushes the fibers upward against fixed platen 94. The upper dogs 88 are retracted to permit the upward movement of the fibers. Wrapping material may be held on the platens, as at 96 and 98 so the bale may be wrapped after pressing and before strapping. Platen 92 is positioned by hydraulic cylinders 100 controlled by valve assembly 102. The cylinders 100 overpress the fibers beyond the strapping pressure and then return to the strapping pressure. The wrap is folded around the bale by conventional auto-wrapping means and the straps are fed through the platen slots and around the bale by conventional strapping means as described in the reference '846 patent. The strapped bale is tipped over and carried away from the baler on conveyor 106. During pressing and strapping of the fiber from chamber 86, chamber 86' is repeatedly charged with fiber and tramped so the cycle can repeat.

Figure 4B:
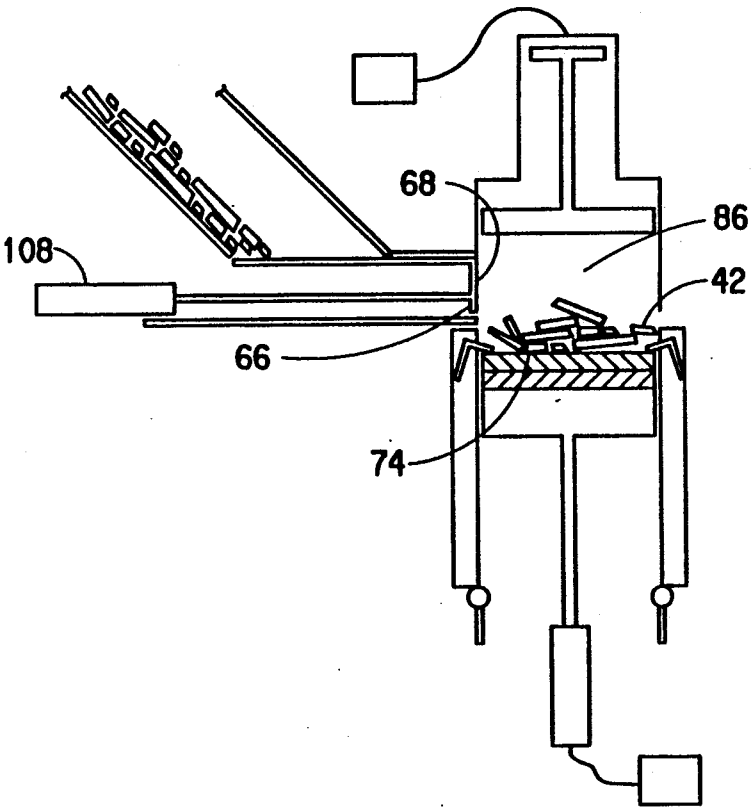
FIGS. 4A–E are schematic side elevation views of the tramping station used in performing the steps of this invention.
Figure 4A:
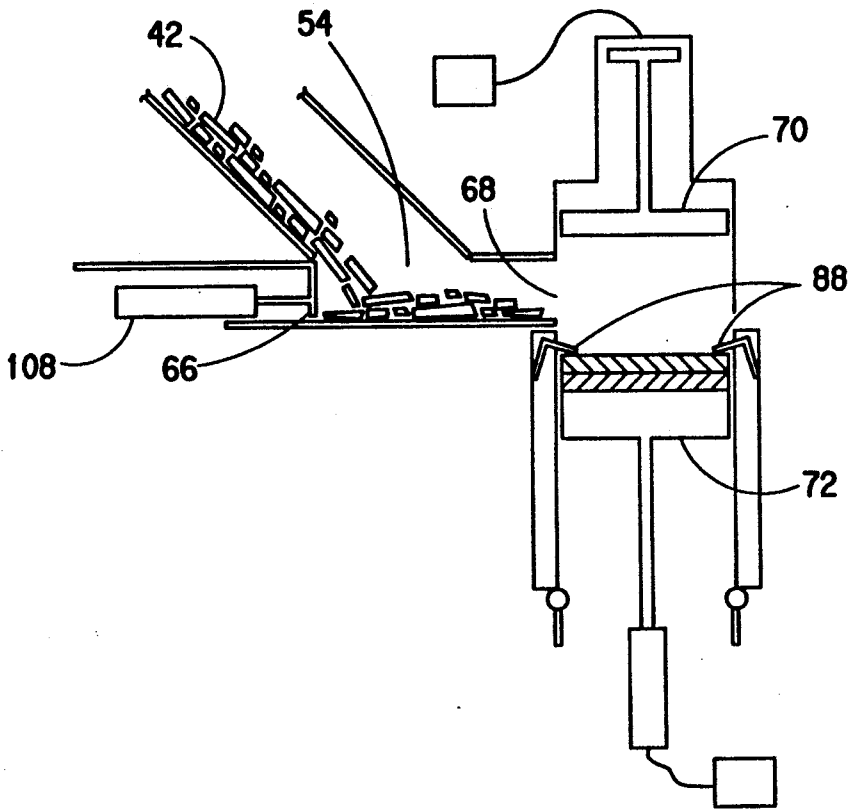
Figure 4C:
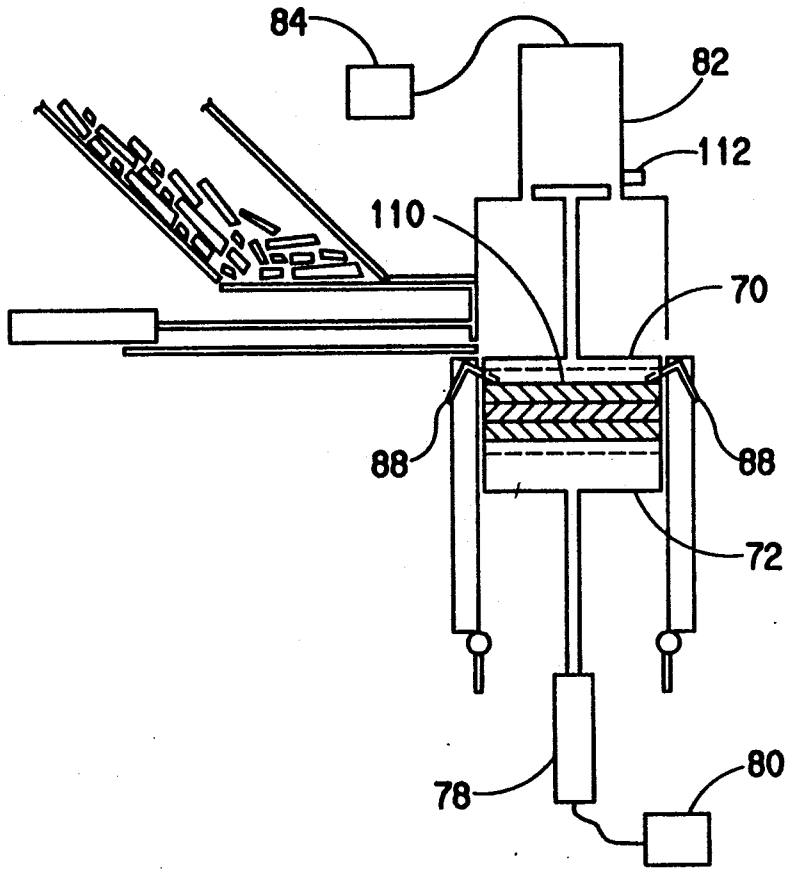
Figure 5:
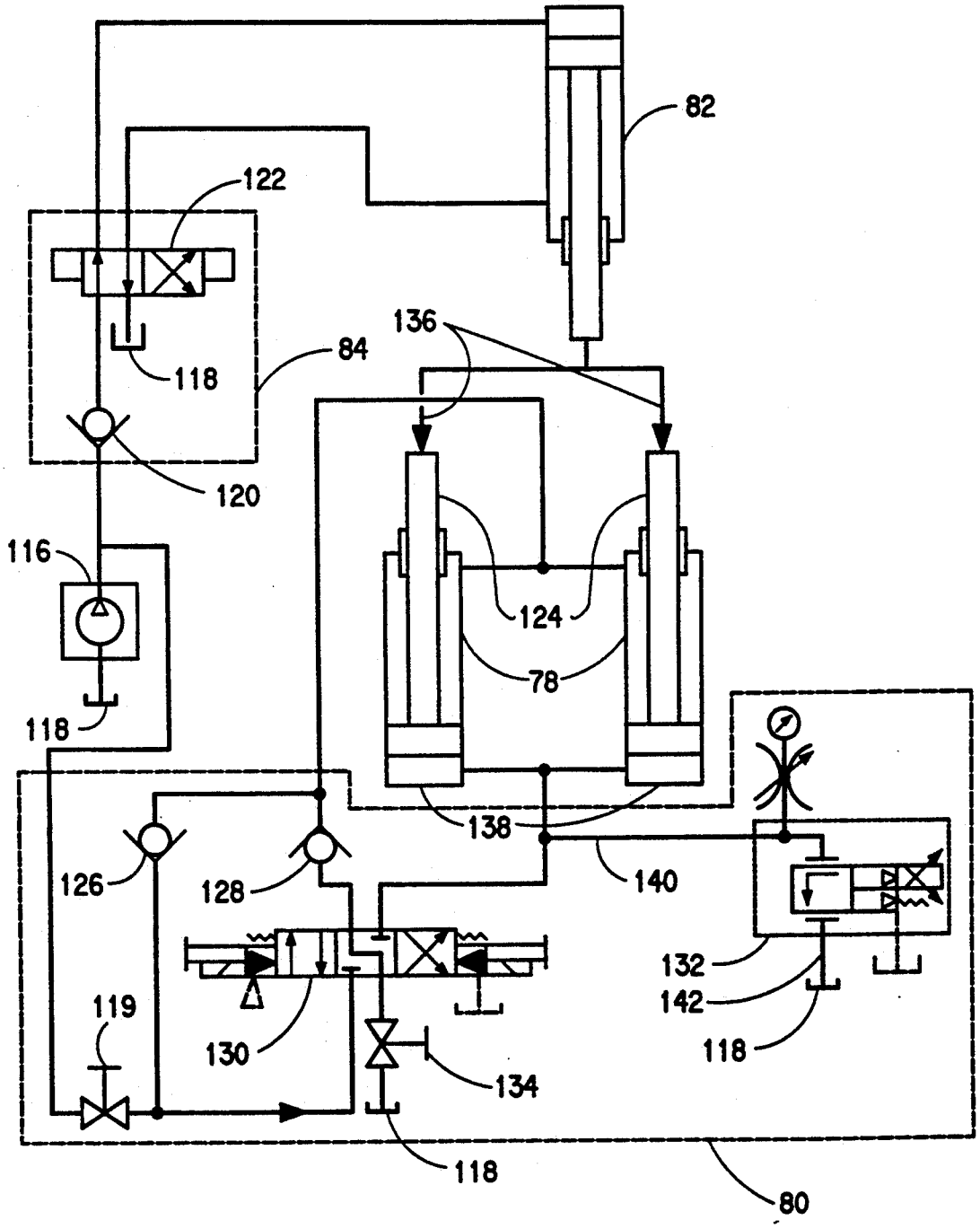
FIG. 5 is a schematic illustration of the fluid control circuit for the tramping station of the bale.

FIGS. 5 A-E show a diagrammatic side section of the tramping station to illustrate the sequence of operations in tramping the fibers. In FIG. 4A, the pusher 66 is retracted so the cut fiber segments 42 can fill charge chamber 54. The support platen has two compacted layers in place which are held in their compacted state by dogs 88. Tramping platen 70 is in the retracted position. In FIG. 4B, pusher cylinder 108 has caused the pusher to move toward chamber 86 thereby pushing the charge of segments 42 through opening 68 onto the top of the last tramped layer at 74. In FIG. 4C, the tramping platen is powered down by cylinder 82 and compacts the segments 42 to form a third layer 110 which is pushed past dogs 88. The force exerted by cylinder 82 causes support platen 72 to be moved down which displaces hydraulic fluid from cylinder 78 through a pressure relief valve in valve assembly 80. The pressure relief valve is set to pass fluid at a selected pressure which is the same for each layer, so each layer is tramped to the same pressure thereby resulting in uniform density in all the layers.

Figure 4D:
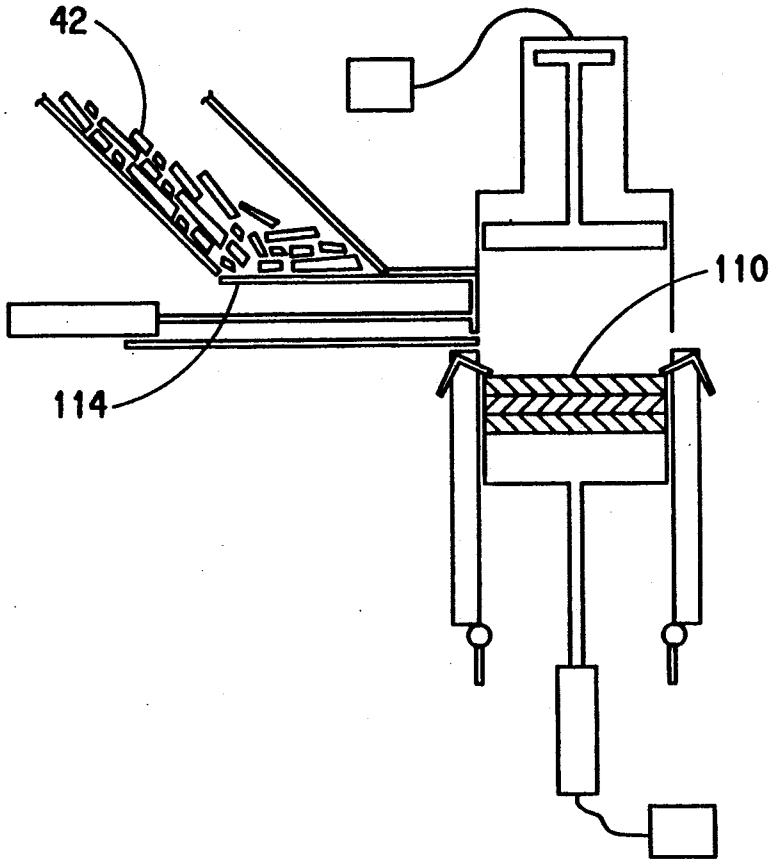
Figure 4E:
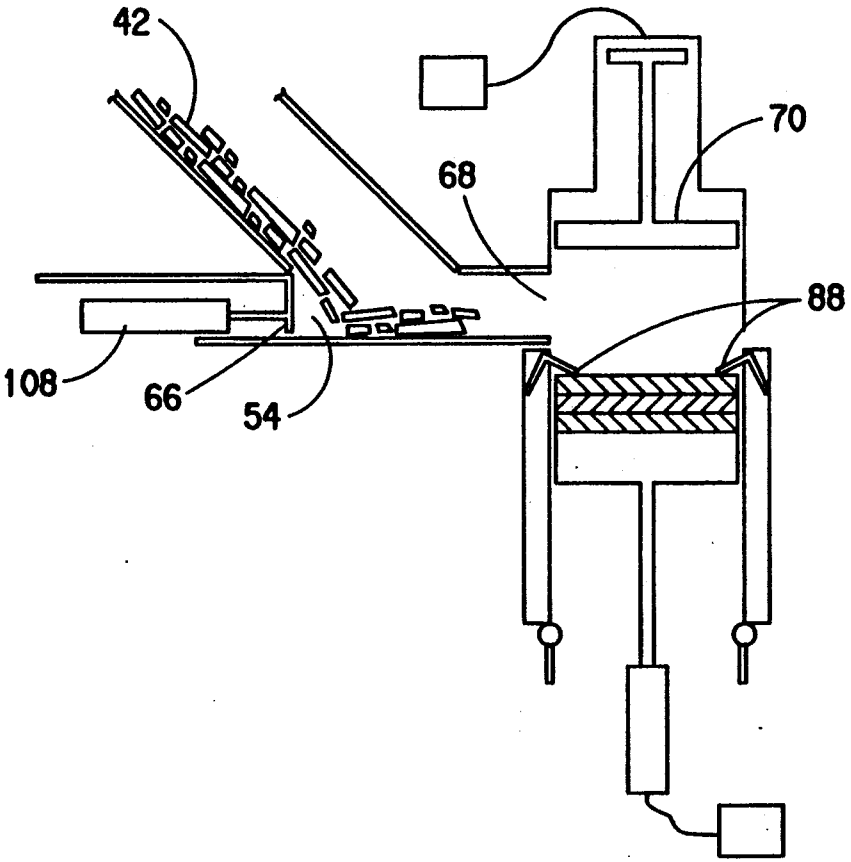

When the tramping platen reaches a selected elevation in chamber 86 sensed by sensor 112, the valve assembly 84 shifts causing the tramping platen to retract as shown in FIG. 4D. The pressure relief valve in valve assembly 80 closes and the directional valve in valve assembly 80 remains closed so support platen 72 remains at the height it was forced to by tramping platen 70. Dogs 88 keep the third layer 110 from expanding upward. All the time the pusher has been forward, additional fiber segments 42 have been piling up on pusher platform 114. In FIG. 4E, pusher 66 is retracted by cylinder 108, thereby allowing the accumulated fiber segments on platform 114 to fill charge chamber 54 ready for the next tramping cycle.

After numerous tramping cycles, chamber 86 (referring back to FIG. 3) is filled with compacted layers of segments. The number of cycles may be determined by a bale weight signal based on the time or number of revolutions, at a certain pounds of tow per hour, that the cutter has been operating. At this point, support platen 72 is lowered past retaining fingers 90 and out of chamber 86. The cutter is stopped during this part of the cycle to avoid overfilling the charge chamber. At this time, pressing platen 92 is also withdrawn from chamber 86' so the dual box assembly 58 is clear to rotate 180 degrees. This places chamber 86 in the pressing and strapping station 64 and chamber 86' in tramping station 62. The tramping cycle can now begin for chamber 86' by extending upper dogs 88' and raising the support platen 72 up into the chamber through the retaining fingers 90' to accept the charge for the first layer.

At the pressing and strapping station, a fabric or film wrap sheet is draped over pressing platen 92 and retaining fingers 90 are opened as pressing platen 92 is raised by cylinders 100. A fabric or film wrap sheet is also held in place on fixed platen 94. Dogs 88 are retracted and pressing platen 92 pushes the compacted layers upward against film covered platen 94. The pressure in cylinders 100 is increased beyond the strapping pressure to overpress the compacted layers for a preselected time to form a highly compacted bale and then is returned to the strapping pressure. Times from 5 seconds to 5 minutes are effective, with 10 seconds preferred. The chamber 86 is retracted downward to expose the compacted bale. The wrapping material is folded around the bale and straps are fed through the slots in platens 92 and 94 to wrap the compacted bale. The pressing platen is retracted until its top elevation aligns with the top of conveyor 106. The bale expands until the straps constrain the bale from further expansion. The bale is then tipped 90 degrees off platen 92 and onto conveyor 106.

FIG. 5 shows a fluid circuit diagram for the tramping station. The relief and directional valves within valve assemblies 80 and 84 are shown. Both valve assemblies are fed pressurized fluid from pump 116 which draws fluid from sump 118 and passes it through shut off valve 119. Valve assembly 84 comprises one way valve 120 and two position directional control valve 122, which in the position shown is directing fluid to the top of tramping cylinder 82 thereby forcing the tramp platen down against the fiber layer on the support platen and displacing the piston rods 124 of support cylinders 78. Valve assembly 80 for the support cylinders comprises one way valves 126 and 128, three position directional control valve 130, electronic proportional relief valve 132, and drain valve 134.

Directional valve 130 is shown in the blocked position with drain valve 134 shut. In this position, the rods 124 are stationary and the cylinders and lines are full of hydraulic fluid. When the tramping cylinders apply force to the support platen the rods 124 are forced down in the direction of arrows 136 which raises the pressure on the piston side 138 of cylinders 78. This pressure is applied through line 140 to the relief valve 132. When the pressure exceeds the preset level for relief, valve 132 relieves the fluid through line 142 to sump 118 and the rods are moved downward until the tramp cylinder 82 reaches the end of its stroke. The fiber layers between the tramp platen and support platen are compacted to a pressure determined by the preset relief level. This level can be programmed to be the same for each layer or it can be electronically changed with each tramp cycle to increase or decrease with each layer either linearly or nonlinearly. For instance, if there are to be 28 layers in the bale, the first layer will be tramped 28 times and held in a compressed state for several minutes and the 28th layer will only be tramped once and held for a few seconds. This may result in a progressively higher density for the lower layers in the bale so it may be desireable to progressively increase the relief pressure for each layer to provide more uniform density from layer to layer throughout the bale. Tramping each layer to a uniform density results in an easily opened bale with uniform fiber properties and processing performance throughout the bale which generally means the bale can be opened more quickly and reliably and the final staple yarn will have more uniform properties.

Baled Product

Figure 6:
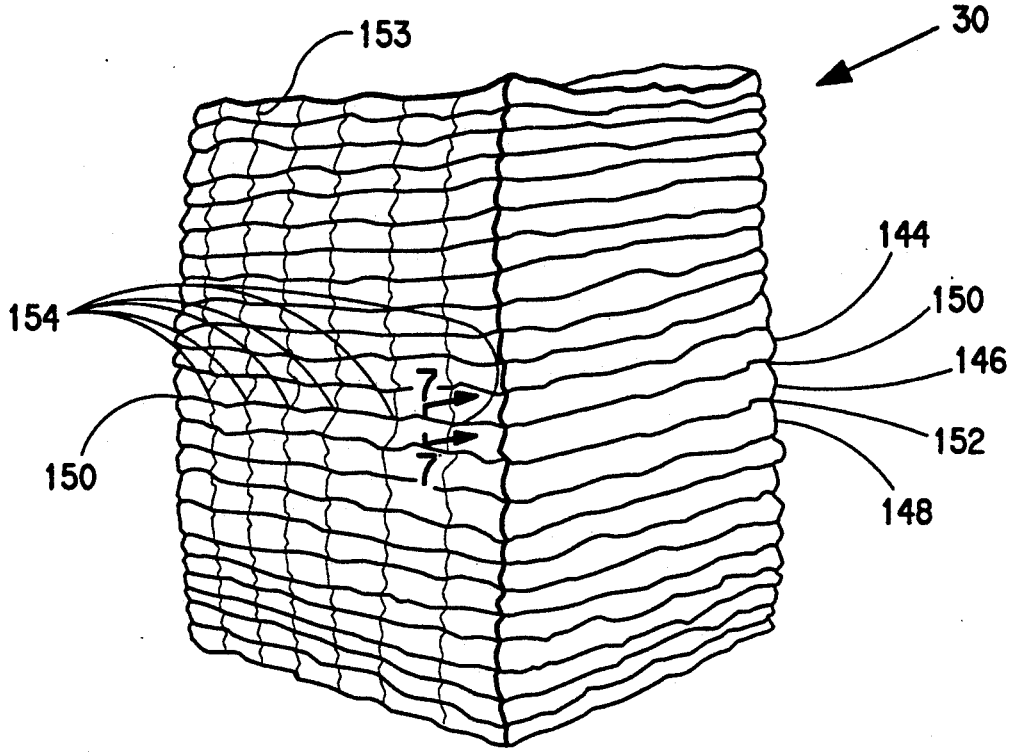
FIGS. 6 and 7 are schematic diagrams of a bale of crimped nylon staple after the straps have been removed.
Figure 7:
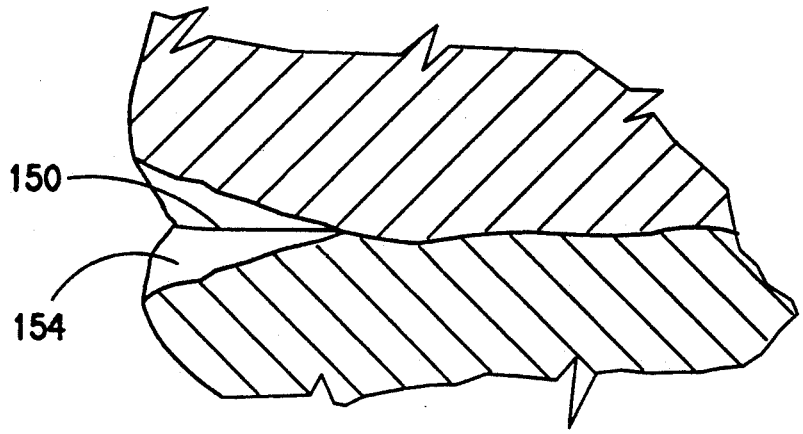

FIG. 6 shows the baled product 30 after the straps have been removed. The bale density after strap removal is dependent on the time the bale 30 was strapped particularly during the first five to seven days and it continues to increase up to four weeks after baling. Preferably, most of the density is realized after about one week. The bale expands after unstrapping and the layers can be distinctly seen by their characteristic bulged edges such as 144, 146 and 148 which meet adjacent layers to define the interface such as 150 and 152 between layers. The vertical lines, such as 153, are marks made on the bale by the access slots for the dogs when the bales are pressed out of the baling chamber. These are also often present on conventional bales. Also characteristic of the bale made by the invention is the presence of a series of indentations at each layer interface along the pair of long opposed sides of the bale. These can be seen at 154 along interface 150. These are left by the dogs used on either side of the baling chambers 86, 86' during the process of the invention where each layer's tramping compaction is held by the dogs. Such indentations at each layer interface are not found on conventional bales. FIG. 7 shows a section through an indentation 154 at the interface 150. The indentation extends into the bale a short distance and is useful during debaling as a way to clearly identify the layer interface for separation and as a convenient place for the operator to insert his hand or a tool to grasp the fibers for easy separation at a layer interface.

When a hand full of fiber is removed from the bale layer of the invention, it separates easily to form a small volume, light weight clump. The cut fibers in the clump can readily be seen as aligned groups of parallel filaments having the cut ends still aligned with one another. There is practically which is characteristic of clumps from a conventional bale. Conventional bale clumps are also noticeably larger and/or heavier than the clumps of the invention. The force to remove a clump of the invention from the bale is unusually low and the fibers in the clump can be separated further by the forces from gravity and gently shaking the clump up and down. This ease of separation is a great advantage when the clumps are carded in that much higher rates can be achieved with less energy and fewer broken filaments.

What is claimed is:

1. A bale of crimped nylon staple fiber comprising: a strapped bale density in the range of from about 18 to about 26 lbs/ft$^3$, a seven day unstrapped density of from about 9 to about 12 lbs/ft$^3$, said fiber being crimped in the range of from 6–20 crimps per inch and having a cut length of about 4 to about 8 inches, a crimp elongation of from about 25 to 45 percent and a moisture content of 4 to 8 percent, said bale being formed of a plurality of separable compacted layers of said yarns stacked one next to the other, each of said layers having substantially the same unstrapped bale density.

2. The bale of claim 1 wherein said bale has a plurality of pairs of opposed sides and a plurality of indentations located on at lest one pair of said opposed sides between said layers.

* * * * *